US008540933B2

(12) United States Patent
Nylöf et al.

(10) Patent No.: US 8,540,933 B2
(45) Date of Patent: Sep. 24, 2013

(54) STAINLESS AUSTENITIC LOW NI STEEL ALLOY

(75) Inventors: Lars Nylöf, Gävle (SE); Anders Söderman, Eskilstuna (SE)

(73) Assignee: Sandvik Intellectual Property AB, Sandviken (SE)

( * ) Notice: Subject to any disclaimer, the term of this patent is extended or adjusted under 35 U.S.C. 154(b) by 17 days.

(21) Appl. No.: 13/146,221

(22) PCT Filed: Jan. 28, 2010

(86) PCT No.: PCT/SE2010/050086

§ 371 (c)(1),
(2), (4) Date: Nov. 1, 2011

(87) PCT Pub. No.: WO2010/087766

PCT Pub. Date: Aug. 5, 2010

(65) Prior Publication Data

US 2012/0034126 A1 Feb. 9, 2012

(30) Foreign Application Priority Data

Jan. 30, 2009 (SE) ..... 0900108

(51) Int. Cl.
*C22C 38/42* (2006.01)
*C22C 38/58* (2006.01)

(52) U.S. Cl.
USPC ..... 420/60; 420/61; 148/325

(58) Field of Classification Search
USPC ..... 148/325; 420/60, 61
See application file for complete search history.

(56) References Cited

U.S. PATENT DOCUMENTS

| | | | |
|---|---|---|---|
| 5,286,310 | A | 2/1994 | Carinci et al. |
| 6,274,084 | B1 | 8/2001 | Haudrechy |
| 6,551,420 | B1 | 4/2003 | Bergstrom et al. |
| 2003/0021716 | A1 | 1/2003 | Hauser et al. |
| 2004/0079451 | A1 | 4/2004 | Hsieh et al. |
| 2009/0041613 | A1 | 2/2009 | Suzuki et al. |

FOREIGN PATENT DOCUMENTS

| | | |
|---|---|---|
| CN | 1978694 | 6/2007 |

(Continued)

OTHER PUBLICATIONS

Machine-English translated JP 6-86645, Nov. 1994.*

(Continued)

*Primary Examiner* — Deborah Yee
(74) *Attorney, Agent, or Firm* — Morgan, Lewis & Bockius LLP

(57) ABSTRACT

An austenitic stainless steel alloy having the following composition in percent of weight (wt %): 0.02≤C≤0.06; Si<1.0; 2.0≤Mn≤6.0; 2.0≤Ni≤4.5; 17≤Cr≤19; 2.0≤Cu≤4.0; 0.15≤N≤0.25; 0≤Mo≤1.0; 0≤W≤0.3; 0≤V≤0.3; 0≤Ti≤0.5; 0≤Al≤1.0; 0≤Nb≤0.5; 0≤Co≤1.0; the balance Fe and normally occurring impurities, wherein the contents of the alloying elements are balanced so that the following conditions are fulfilled:

$Ni_{eqv}-1.42*Cr_{eqv}\leq-13.42$; and $Ni_{eqv}+0.85*Cr_{eqv}\geq29.00$ wherein $Cr_{eqv}$=[% Cr]+2*[% Si]+1.5*[% Mo]+5*[% V]+5.5*[% Al]+1.75*[% Nb]+1.5*[% Ti]+0.75*[% W]

$Ni_{eqv}$[% Ni]+[% Co]+0.5*[% Mn]+0.3*[% Cu]+25*[% N]+30*[% C];

and

−70° C.<MD30<−25° C., wherein

MD30=(551−462*([% C]+[% N])−9.2*[% Si]−8.1*[% Mn]−13.7*[% Cr]−29*([% Ni]+[% Cu])−68*[% Nb]−18.5*[% Mo])° C.

15 Claims, 1 Drawing Sheet

(56) References Cited

FOREIGN PATENT DOCUMENTS

| | | |
|---|---|---|
| CN | 101363103 | 2/2009 |
| EP | 0 314 649 | 5/1989 |
| EP | 0 337 846 | 10/1989 |
| EP | 1 431 408 | 6/2004 |
| EP | 2 025 770 | 2/2009 |
| GB | 2 071 147 | 9/1981 |
| JP | 49-3810 | 1/1974 |
| JP | 61-124556 | 6/1986 |
| JP | 6-86645 | * 11/1994 |
| JP | 3002357 | 11/1999 |
| JP | 2003-231951 | 8/2003 |
| JP | 2006-219751 | 8/2006 |
| JP | 2007-63632 | 3/2007 |
| JP | 2007-197806 | 8/2007 |
| JP | 2008-38191 | 2/2008 |
| WO | 00/26428 | 5/2000 |
| WO | WO 02/27056 | 4/2002 |
| WO | WO 2005/045082 | 5/2005 |
| WO | WO 2006/071027 | 7/2006 |
| WO | WO 2006/084919 | 8/2006 |

OTHER PUBLICATIONS

European Search Report dated Jun. 19, 2009 for European Application No. 09 15 5355.2 filed Mar. 17, 2009.

Notification of the First Office Action (and English translation) for Chinese Application No. 201080006124.0 , dated Nov. 21, 2012.

Office Action for European Patent Application No. 09 155 355.2, dated Aug. 31, 2009.

Novelty Search (no translation) for Swedish Patent Application No. 164279, dated Apr. 4, 2008.

J. Charles, et al.; "A New European 200 Series Standard to Substitute 304 Austenitics?"; Proceedings, 6th European Stainless Steel Science and Market Conference, Helsinki, Jernkontoret, 2008; pp. 427-436.

L. Appolloni, et al.; New Grade in TKL-AST of High-Nitrogen Austenitic Stainless Steels (HNASS); paper presented to European Stainless Steel Conference, Helsinki, Jun. 10-13, 2008; pp. 373-379.

B. Van Hecke; "17-4Mn: an alternative to grade 304"; Stainless Steel World, Sep. 1, 2008. (4 pages).

S. Vermoolen; "Science and Market"; 6th European Stainless Steel Conference, Helsinki, Jun. 10-13, 2008. (2 pages).

* cited by examiner

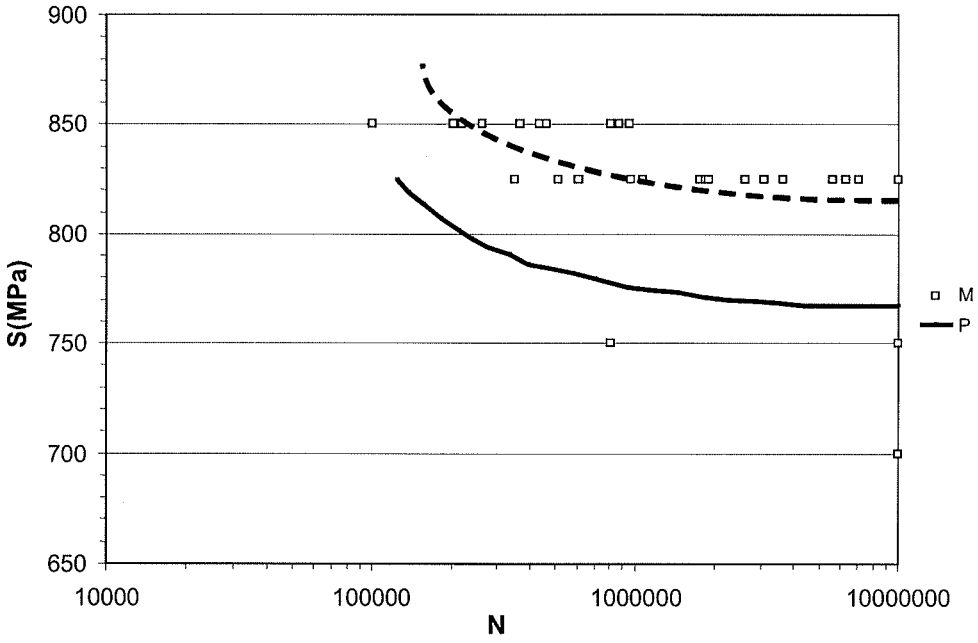
900
850
800
750
700
650
S(MPa)
10000
100000
1000000
10000000
N
M
P

STAINLESS AUSTENITIC LOW NI STEEL ALLOY

CROSS REFERENCE TO RELATED APPLICATIONS

This application is a §371 National Stage Application of PCT International Application No. PCT/SE2010/050086, filed Jan. 28, 2010, and claims priority under 35 U.S.C. §119 and/or §365 to Swedish Application No. 0900108-2 filed Jan. 30, 2009.

TECHNICAL FIELD

The present invention relates to an austenitic stainless steel alloy of low nickel content. The invention also relates to an article manufactured from the steel alloy.

BACKGROUND ART

Austenitic stainless steel is a common material for various applications since these types of steels exhibit good corrosion resistance, good mechanical properties as well as good workability. Standard austenitic stainless steels comprise at least 17 percent chromium, 8 percent nickel and the rest iron. Other alloying elements are also often included.

The fast growing need for stainless steels around the world and the following high demand of alloying metals in the steel production has lead to increases in metal prices. Especially nickel has become expensive. Various attempts have therefore been made to substitute nickel in austenitic stainless steels with other alloying elements, for example as described in U.S. Pat. No. 5,286,310 A1, U.S. Pat. No. 6,274,084 and JP3002357.

The steels described above exhibit good hot workability and high deformation hardening. These are properties which are important for the manufacturing of articles of large dimensions, such as heavy sheets. However, the steels described above have proven unsuitable for certain articles which require cold working including large reduction ratios.

WO0026428 describes a low nickel steel alloy in which the amount of alloy elements have been combined to achieve a formable steel which exhibit good resistance to corrosion and work hardening. Further, the steel contains expensive alloy elements. Another steel alloy is described in JP2008038191. In this steel alloy, the elements have been balanced for improving the surface conditions of the steel. However, the properties of the above mentioned steel alloys make them unsuitable for processes involving cold working including large reduction ratios.

SUMMARY OF THE INVENTION

Thus, one object of the present invention is to provide a low nickel austenitic stainless steel alloy, which can be cold worked with large reduction ratios. Hereinafter, the inventive austenitic stainless steel alloy is referred to as the steel alloy.

The inventive steel alloy should have good mechanical properties, comparable to the known steel grade AISI 302, as well as good corrosion properties. The composition of the steel alloy should be carefully balanced with regard to the influence of each alloy element so that a cost effective steel alloy is achieved, which fulfils the demands on productivity and final properties. Thus, the steel alloy should exhibit good hot workability properties. The steel alloy should further be so ductile and stable against deformation hardening such that it can be cold worked at high productivity at high reduction ratios without cracking or becoming brittle.

A further object of the present invention is to provide an article manufactured from the improved austenitic stainless steel alloy.

The aforementioned objects are met by an austenitic stainless steel alloy having the following composition in percent of weight (wt %):

$0.02 \le C \le 0.06$ $Si < 1.0$ $2.0 \le Mn \le 6.0$ $2.0 \le Ni \le 4.5$ $17 \le Cr \le 19$ $2.0 \le Cu \le 4.0$ $0.15 \le N \le 0.25$ $0 \le Mo \le 1.0$ $0 \le W \le 0.3$ $0 \le V \le 0.3$ $0 \le Ti \le 0.5$ $0 \le Al \le 1.0$ $0 \le Nb \le 0.5$ $0 \le Co \le 1.0$ the balance Fe and normally occurring impurities, characterized in that the contents of the alloying elements are adjusted so that the following conditions are fulfilled:

$Ni_{eqv} - 1.42 * Cr_{eqv} \le -13.42$; and $Ni_{eqv} + 0.85 * Cr_{eqv} \ge 29.00$ wherein $Cr_{eqv} = [\%\ Cr] + 2*[\%\ Si] + 1.5*[\%\ Mo] + 5*[\%\ V] + 5.5*[\%\ Al] + 1.75*[\%\ Nb] + 1.5*[\%\ Ti] + 0.75*[\%\ W]$ $Ni_{eqv}[\%\ Ni] + [\%\ Co] + 0.5*[\%\ Mn] + 0.3*[\%\ Cu] + 25*[\%\ N] + 30*[\%\ C]$ and $-70°\ C. < MD30 < -25°\ C.$ wherein $MD30 = (551 - 462*([\%\ C] + [\%\ N]) - 9.2*[\%\ Si] - 8.1*[\%\ Mn] - 13.7*[\%\ Cr] - 29*([\%\ Ni] + [\%\ Cu]) - 68*[\%\ Nb] - 18.5*[\%\ Mo])°\ C.,$ whereby the risk of a too high deformation hardening of a low nickel austenitic steel alloy can be avoided, which guarantees that optimal mechanical properties are achieved in the steel alloy during working. The risk of forming martensite on cooling or during cold deformation is depressed, so that deformation hardening can be controlled and optimal mechanical properties, especially ductility, are achieved in the steel alloy, lowering the risk of crack formation.

The particular composition provides a cost effective low nickel austenitic stainless steel alloy with excellent mechanical properties, excellent workability properties and improved resistance to corrosion compared to other low nickel austenitic stainless steel alloys. The workability properties of the steel alloy are optimized with regard to cold forming and reduced nickel content. The steel alloy is especially suitable for manufacturing processes which involve large reduction ratios of the steel. Articles of small dimensions, for example springs, can thereby readily be achieved from the steel alloy. For example, wires may readily be manufactured from the steel alloy by cold drawing. Other examples of articles include, but are not limited to, strips, tubes, pipes, bars and products manufactured by cold-heading and forging. An advantage of the inventive steel alloy is that that it allows for the manufacturing of an article by cold working in fewer production steps since the number of intermediate heat treatments can be reduced. Articles produced by the steel alloy have proven very cost effective since the amounts of the alloying elements are carefully optimized with regard to their effect on the properties of the steel alloy.

The contents of the alloy elements in the steel alloy may preferably be adjusted such that the following condition is fulfilled:

$$Ni_{eqv}-1.42*Cr_{eqv}\geq-16.00$$

whereby the phase fraction of ferrite in the microstructure is restricted and optimal mechanical properties, especially ductility, together with acceptable corrosion resistance, can be achieved in the steel alloy.

The contents of the alloy elements in the steel alloy may preferably be adjusted such that the following condition is fulfilled:

$$Ni_{eqv}+0.85*Cr_{eqv}\leq31.00$$

whereby the risk of a too high deformation hardening of the untransformed austenitic phase can be avoided and the formation of unwished phases such as $Cr_2N$ and $N_2$ (gas) can be controlled, which guarantees that optimal mechanical properties are achieved in the steel alloy.

The contents of the alloy elements in the steel alloy may preferably be balanced such that the following condition is fulfilled:

$$Ni_{eqv}+0.85*Cr_{eqv}\leq30.00$$

whereby the risk of a too high deformation hardening of the untransformed austenitic phase can be avoided and the formation of unwished phases such as $Cr_2N$ and $N_2$ (gas) can be controlled, which guarantees that optimal mechanical properties, are achieved in the steel alloy.

Preferably is the amount of silicon in the steel alloy ≤0.6 wt %. Preferably is the amount of manganese in the steel alloy in the range between 2.0-5.5 wt %, more preferably 2.0-5.0 wt %. Preferably is the amount of nickel in the steel alloy in the range between 2.5-4.0 wt %. Preferably is the amount of chromium in the steel alloy in the range between 17.5-19 wt %. Preferably is the amount of molybdenum in the steel alloy in the range between 0-0.5 wt %. Preferably is the amount of each of tungsten, vanadium, titanium, aluminium and niob in the steel alloy, (W, V, Ti, Al, Nb)≤0.2 wt %. More preferably is the amount of each of W, V, Ti, Al, Nb≤0.1 wt % and the amount of (W+V+Ti+Al+Nb)≤0.3 wt %. Preferably is the amount of cobalt in the steel alloy in the range between 0-0.5 wt %.

The steel alloy may advantageously be included in an article, for example a wire, a spring, a strip, a tube, a pipe, a bar, and products manufactured by cold-heading and forging.

The steel alloy is optimal for use in the manufacture of an article, for example a wire, a spring, a strip, a tube, a pipe, a cold-headed article or a forged article or an article produced by cold pressing/cold forming.

DETAILED DESCRIPTION OF THE INVENTION

The inventors of the present invention have found that by carefully balancing the amounts of the alloy elements described below both with regard to the effects of each separate element and to the combined effect of several elements a steel alloy is achieved which has excellent ductility and workability properties as well as improved corrosion resistance compared to other low nickel austenitic stainless steel alloys. In particular it was found that optimal properties are achieved in the steel alloy when the amounts of the alloying elements are balanced according to relationships described below.

Following is a description of the effects of the various elements of the steel alloy together with an explanation of the limitation of each alloy element.

Alloying Elements

Carbon (C) stabilizes the austenitic phase of the steel alloy at high and low temperatures. Carbon also promotes deformation hardening by increasing the hardness of the martensitic phase, which to some extent is desirable in the steel alloy. Carbon further increases the mechanical strength and the aging effect of the steel alloy. However, a high amount of carbon drastically reduces the ductility and the corrosion resistance of the steel alloy. The amount of carbon should therefore be limited to a range from 0.02 to 0.06 wt %.

Silicon (Si) is necessary for removing oxygen from the steel melt during manufacturing of the steel alloy. Silicon increases the aging effect of the steel alloy. Silicon also promotes the formation of ferrite and in high amounts, silicon increases the tendency for precipitation of intermetallic phases. The amount of silicon in the steel alloy should therefore be limited to a maximum of 1.0 wt %. Preferably is the amount of silicon limited to a range from 0.2 to 0.6 wt %.

Manganese (Mn) stabilizes the austenite phase and is therefore an important element as a replacement for nickel, in order to control the amount of ferrite phase formed in the steel alloy. However, at very high contents, manganese will change from being an austenite stabilizing element to become a ferrite stabilizing element. Another positive effect of manganese is that it promotes the solubility of nitrogen in the solid phase, and by that also indirectly increases the stability of the austenitic microstructure. Manganese will however increase the deformation hardening of the steel alloy, which increases the deformation forces and lowers the ductility, causing an enlarged risk of formation of cracks in the steel alloy during cold working. Increased amounts of manganese also reduces the corrosion resistance of the steel alloy, especially the resistance against pitting corrosion. The amount of manganese in the steel alloy should therefore be limited to a range from 2.0 to 6.0 wt %, preferably is the amount of manganese limited to a range from 2.0 to 5.5 wt %, more preferably to a range from 2.0 to 5.0 wt %.

Nickel (Ni) is an expensive alloying element giving a large contribution to the alloy cost of a standard austenitic stainless steel alloy. Nickel promotes the formation of austenite and thus inhibits the formation of ferrite and improves ductility and to some extent the corrosion resistance. Nickel also stabilizes the austenite phase in the steel alloy from transforming into martensite phase (deformation martensite) during cold working. However, to achieve a proper balance between the austenite, ferrite and martensite phases on one hand, and the total alloy element cost of the steel alloy on the other hand, the amount of nickel should be in the range from 2.0 to 4.5 wt %, preferably is the amount of nickel limited to a range from 2.5 to 4.0 wt %.

Chromium (Cr) is an important element of the stainless steel alloy since it provides corrosion resistance by the formation of a chromium-oxide layer on the surface of the steel alloy. An increase in chromium content can therefore be used to compensate for changes in other elements, causing reduced corrosion properties, in order to accomplish an optimal corrosion resistance of the steel alloy. Chromium promotes the solubility of nitrogen in the solid phase which has a positive effect on the mechanical strength of the steel alloy. Chromium also reduces the amount of deformation martensite during cold working, and by that indirectly helps to maintain the austenitic structure, which improves the cold workability of the steel alloy. However, at high temperatures the amount of ferrite (delta ferrite) increases with increasing chromium content which reduces the hot workability of the steel alloy. The amount of chromium in the steel alloy should therefore be in the range from 17 wt % to 19 wt %, preferably is the amount of chromium limited to a range from 17.5 to 19 wt %.

Copper (Cu) increases the ductility of the steel and stabilizes the austenite phase and thus inhibits the austenite-to-martensite transformation during deformation which is favourable for cold working of the steel. Copper will also reduce the deformation hardening of the untransformed austenite phase during cold working, caused by an increase in the stacking fault energy of the steel alloy. At high temperatures, a too high amount of copper sharply reduces the hot workability of the steel, due to an extended risk of exceeding the solubility limit for copper in the matrix and to the risk of forming brittle phases. Besides that, additions of copper will improve the strength of the steel alloy during tempering, due to an increased precipitation hardening. At high nitrogen contents, copper promotes the formation of chromium nitrides which may reduce the corrosion resistance and the ductility of the steel alloy. The amount of copper in the steel alloy should therefore be limited to a range from 2.0 wt % to 4.0 wt %.

Nitrogen (N) increases the resistance of the steel alloy towards pitting corrosion. Nitrogen also promotes the formation of austenite and depresses the transformation of austenite into deformation martensite during cold working. Nitrogen also increases the mechanical strength of the steel alloy after completed cold working, which can be further improved by a precipitation hardening, normally produced by a precipitation of small particles in the steel alloy during a subsequent tempering operation. However, higher amounts of nitrogen lead to increasing deformation hardening of the austenitic phase, which has a negative impact on the deformation force. Even higher amounts of nitrogen also increase the risk of exceeding the solubility limit for nitrogen in the solid phase, giving rise to gas phase (bubbles) in the steel. To achieve a correct balance between the effect of stabilization of the austenitic phase and the effect of precipitation hardening and deformation hardening, the content of nitrogen in the steel alloy should be limited to a range from 0.15 to 0.25 wt %.

Molybdenum (Mo) greatly improves the corrosion resistance in most environments. However, molybdenum is an expensive alloying element and it also has a strong stabilizing effect on the ferrite phase. Therefore, the amount of molybdenum in the steel alloy should be limited to a range from 0 to 1.0 wt %, preferably 0 to 0.5 wt %.

Tungsten (W) stabilizes the ferrite phase and has a high affinity to carbon. However, high contents of tungsten in combination with high contents of Cr and Mo increase the risk of forming brittle inter-metallic precipitations. Tungsten should therefore be limited to a range from 0 to 0.3 wt %, preferably 0 to 0.2 wt %, more preferably 0 to 0.1 wt %.

Vanadium (V) stabilizes the ferrite phase and has a high affinity to carbon and nitrogen. Vanadium is a precipitation hardening element that will increase the strength of the steel after tempering. Vanadium should be limited to a range from 0 to 0.3 wt % in the steel alloy, preferably 0 to 0.2 wt %, more preferably 0 to 0.1 wt %.

Titanium (Ti) stabilizes the delta ferrite phase and has a high affinity to nitrogen and carbon. Titanium can therefore be used to increase the solubility of nitrogen and carbon during meting or welding and to avoid the formation of bubbles of nitrogen gas during casting. However, an excessive amount of Ti in the material causes precipitation of carbides and nitrides during casting, which can disrupt the casting process. The formed carbon-nitrides can also act as defects causing a reduced corrosion resistance, toughness, ductility and fatigue strength. Titanium should be limited to a range from 0 to 0.5 wt %, preferably 0 to 0.2 wt %, more preferably 0 to 0.1 wt %.

Aluminium (Al) is used as de-oxidation agent during melting and casting of the steel alloy. Aluminium also stabilizes the ferrite phase and promotes precipitation hardening. Aluminium should be limited to a range from 0 to 1.0 wt %, preferably 0 to 0.2 wt %, more preferably 0 to 0.1 wt %.

Niobium (Nb) stabilizes the ferrite phase and has a high affinity to nitrogen and carbon. Niobium can therefore be used to increase the solubility of nitrogen and carbon during melting or welding. Niobium should be limited to a range from 0 to 0.5 wt %, preferably 0 to 0.2 wt %, more preferably 0 to 0.1 wt %.

Cobalt (Co) has properties that are intermediate between those of iron and nickel. Therefore, a minor replacement of these elements with Co, or the use of Co-containing raw materials will not result in any major change in properties of the steel alloy. Co can be used to replace some Ni as an austenite-stabilizing element and increases the resistance against high temperature corrosion. Cobalt is an expensive element so it should be limited to a range from 0 to 1.0 wt %, preferably 0 to 0.5 wt %.

The steel alloy may also contain minor amounts of normally occurring contamination elements, for example sulphur and phosphorus. These elements should not exceed 0.05 wt % each.

Chromium-Nickel Equivalent

The balance between the alloy elements which promotes stabilization of the austenite and ferrite (delta ferrite) phases is important since the hot and cold workability of the steel alloy generally depends on the amount of delta ferrite in the steel alloy. If the amount of delta ferrite in the steel alloy is too high, the steel alloy may exhibit a tendency towards hot cracking during hot rolling and reduced mechanical properties such as strength and ductility during cold working. Additionally, delta ferrite can act as precipitation sites for chromium nitrides, carbides or inter-metallic phases. Delta ferrite will also drastically reduce the corrosion resistance of the steel alloy.

The chromium equivalent is a value corresponding to the ferrite stability and its effect on the phases formed in the microstructure during solidification of the steel alloy. The chromium equivalent may be derived from the modified Schaeffler DeLong diagram and is defined as:

$$Cr_{eqv}=[\%\ Cr]+2*[\%\ Si]+1.5*[\%\ Mo]+5*[\%\ V]+5.5*[Al]+1.75*[\%\ Nb]+1.5*[\%\ Ti]+0.75*[\%\ W]. \quad (1)$$

The nickel equivalent is a value corresponding to the austenite stability and its effect on the phases formed in the microstructure during solidification of the steel alloy. The nickel equivalent may also be derived from the modified Schaeffler DeLong diagram and is defined as:

$$Ni_{eqv}=[\%\ Ni]+[\%\ Co]+0.5*[\%\ Mn]+0.3*[\%\ Cu]+25*[\%\ N]+30*[\%\ C]. \quad (2)$$

Reference: D. R. Harries, Int. Conf. on Mechanical Behaviour and Nuclear Applications of Stainless Steels at Elevated Temperatures, Varese, 1981.

It has been found that very good cold working properties at high reduction ratios, improved ductility, reduced deformation hardening and reduced tendency for surface cracking is achieved, when the amounts of alloy elements in the steel alloy are balanced such that equations 1 and 2 fulfil condition B1.

$$Ni_{eqv}-1.42*Cr_{eqv}5-13.42 \quad (B1)$$

Preferably, the amount of delta ferrite stabilizing alloying elements according to equation 1 and the amount of austenite stabilizing alloying elements according to equation 2 should be balanced such that condition B2 is fulfilled.

$$Ni_{eqv}-1.42*Cr_{eqv}\geq-16.00 \quad (B2)$$

The amount of delta ferrite stabilizing alloying elements according to equation 1 and the amount of austenite stabilizing alloying elements according to equation 2 should be balanced such that condition B3 is fulfilled.

$$Ni_{eqv}+0.85*Cr_{eqv}\geq29.00 \quad (B3)$$

Preferably, the amount of delta ferrite stabilizing alloying elements according to equation 1 and the amount of austenite stabilizing alloying elements according to equation 2 should be balanced such that condition B4 is fulfilled.

$$Ni_{eqv}+0.85*Cr_{eqv}\leq31.00 \quad (B4)$$

Preferably, the amount of delta ferrite stabilizing alloying elements according to equation 1 and the amount of austenite stabilizing alloying elements according to equation 2 should be balanced such that condition B5 is fulfilled.

$$Ni_{eqv}+0.85*Cr_{eqv}\leq30.00 \quad (B5)$$

When relationships B1 and B3 are fulfilled the combination of ferrite and austenite forming alloy elements in the steel alloy is excellent. In the steel alloy, the amount of delta ferrite in the austenite matrix is balanced as well as the stability of the austenite phase and the amount of deformation martensite. The steel alloy therefore exhibits excellent mechanical and workability properties and good corrosion resistance. The properties of the steel alloy may further be improved by optimizing the balance between ferrite and austenite forming alloy elements according to relationships B2, B4 and B5.

Alloy compositions that do not fulfil relationship B1, generally have too high amount of austenite stabilizing elements in relation to the ferrite stabilizing elements, and in view of the low amounts of delta ferrite phase formed. In a low nickel stainless steel alloy a high austenite stability is mainly accomplished by an increase in the manganese or nitrogen contents, causing a high stability of the austenite phase, followed by an increased deformation hardening of this phase during working.

Alloy compositions that fulfil relationship B2, exhibit increased ductility during working and improved corrosion resistance since the amount of ferrite stabilizing elements in relation to the austenite stabilizing elements is balanced such that an optimal amount of delta ferrite phase is achieved in the steel alloy.

Alloy compositions that fulfil relationship B3, exhibit reduced deformation hardening and an increased ductility, mainly during cold working. The improvement of these properties is mainly due to that the amounts of both ferrite and austenite stabilizing elements are high enough to cause a stable austenite phase with low amounts of deformation martensite.

Alloy compositions that fulfil relationships B4 and B5 exhibit improved mechanical properties, since the optimized amounts of both ferrite and austenite stabilizing elements decreases the deformation hardening of the matrix during working.

Formation of Martensite

The relationship between alloying elements which depress the formation of martensite in the steel alloy is important for strength and ductility of the steel alloy. Low ductility at room temperature depends to a certain extent on deformation hardening, which is caused by the transformation of austenite into martensite during cold working of the steel alloy. Martensite increases the strength and hardness of the steel. However, if too much martensite is formed in the steel, it may be difficult to work in cold conditions, due to increased deformation forces. Too much martensite also decreases the ductility and may cause cracks in the steel during cold working of the steel alloy.

The stability of the austenite phase in the steel alloy during cold deforming may be determined by the MD30 value of the steel alloy. MD30 is the temperature, in ° C., where a deformation corresponding to $\epsilon=0.30$ (logarithmic strain), leads to the conversion of 50% of the austenite to deformation martensite. Thus, a decreased MD30 temperature corresponds to an increased austenite stability, which will lower the deformation hardening during cold working, due to a reduced formation of deformation martensite. The MD30 value of the inventive steel alloy is defined as:

$$MD30=(551-462*([\%\ C]+[\%\ N])-9.2*[\%\ Si]-8.1*[\%\ Mn]-13.7*[\%\ Cr]-29*([\%\ Ni]+[\%\ Cu])-68*[\%\ Nb]-18.5*[\%\ Mo])^\circ\ C. \quad (3)$$

Reference: K. Nohara, Y. Ono and N. Ohashi, Tetsu-to-Hagane, 1977; 63:2772

It has been found that very good cold working properties in combination with optimal mechanical strength is achieved in the steel alloy when the alloy elements of the steel alloy are adjusted such that equation 3 fulfils the condition B6 below.

$$-70^\circ\ C.<MD30<-25^\circ\ C. \quad (B6)$$

DESCRIPTION OF DRAWINGS

FIG. 1 shows a S-N curve at 90% security against failure of tempered springs coiled from wire 1.0 mm in diameter. S is the stress in MPa and N is the number of cycles. The mean stress is 450 MPa.

EXAMPLES

The invention will in the following be described by concrete examples.

Example 1

Heats of steel alloys according to the invention named: A, B, C were prepared. As comparison were also heats of comparative steel alloys named D, E, F, G, H, I, J, K, L. The heats were prepared on laboratory scale by melting of component elements in a crucible placed in an induction furnace. The composition of each heat is shown in table 1a and 1b.

Equations 1-3 were calculated for each heat of steel alloy, table 2 shows the results from the calculations. The results from table 2 were then compared with the conditions for each equation, B1-B6 and it was determined if the test heats fulfilled the conditions B1-B6. Table 3 shows the result of the comparison. A "YES" means that the condition is fulfilled, a "NO" means that the condition is not fulfilled.

The melts were cast into small ingots and samples of steel alloy having dimensions of 4×4×3 $mm^3$ were prepared from each heat.

TABLE 1a

| Composition in wt % of inventive steel alloys. | | | |
|---|---|---|---|
| Alloy element | Heat A | Heat B | Heat C |
| C | 0.049 | 0.044 | 0.023 |
| N | 0.20 | 0.20 | 0.21 |
| Si | 0.33 | 0.33 | 0.58 |
| Mn | 4.98 | 4.93 | 4.37 |
| Ni | 3.73 | 3.72 | 3.78 |

TABLE 1a-continued

| Composition in wt % of inventive steel alloys. | | | |
|---|---|---|---|
| Alloy element | Heat A | Heat B | Heat C |
| Cr | 18.32 | 18.31 | 18.09 |
| Cu | 2.41 | 2.44 | 2.63 |
| Mo | 0.01 | 0.01 | 0.13 |
| Nb | <0.01 | <0.01 | <0.01 |
| P | 0.013 | 0.013 | 0.018 |
| S | 0.009 | 0.007 | 0.001 |
| Co | 0.025 | 0.026 | 0.033 |
| Ti | <0.005 | <0.005 | <0.005 |
| V | 0.035 | 0.035 | 0.051 |
| W | 0.01 | 0.02 | 0.01 |

TABLE 1b

| Composition in wt % of comparative steel alloys. | | | | | | | | | |
|---|---|---|---|---|---|---|---|---|---|
| Alloy element | Heat D | Heat E | Heat F | Heat G | Heat H | Heat I | Heat J | Heat K | Heat L |
| C | 0.050 | 0.046 | 0.041 | 0.023 | 0.023 | 0.025 | 0.075 | 0.081 | 0.051 |
| N | 0.19 | 0.20 | 0.20 | 0.20 | 0.15 | 0.20 | 0.11 | 0.14 | 0.16 |
| Si | 0.31 | 0.33 | 0.25 | 0.56 | 0.60 | 0.59 | 0.24 | 0.31 | 0.38 |
| Mn | 6.92 | 4.95 | 4.26 | 4.26 | 3.70 | 4.29 | 2.17 | 3.12 | 4.16 |
| Ni | 3.68 | 3.72 | 3.67 | 1.65 | 3.63 | 3.54 | 3.73 | 3.80 | 3.77 |
| Cr | 17.96 | 18.17 | 18.03 | 17.92 | 16.33 | 17.88 | 18.24 | 18.25 | 18.40 |
| Cu | 2.38 | 3.38 | 2.41 | 2.90 | 2.86 | 1.67 | 3.56 | 2.95 | 2.92 |
| Mo | 0.01 | 0.01 | 0.01 | 0.13 | 0.12 | 0.13 | <0.01 | <0.01 | 0.01 |
| Nb | <0.01 | <0.01 | <0.01 | <0.01 | <0.01 | <0.01 | <0.01 | <0.01 | <0.01 |
| P | 0.013 | 0.013 | 0.013 | 0.018 | 0.018 | 0.018 | 0.011 | 0.010 | 0.011 |
| S | 0.008 | 0.009 | 0.005 | 0.001 | 0.002 | 0.001 | 0.004 | 0.002 | 0.003 |
| Co | 0.024 | 0.025 | 0.025 | 0.031 | 0.031 | 0.032 | 0.021 | 0.024 | 0.022 |
| Ti | <0.005 | <0.005 | <0.005 | <0.005 | <0.005 | <0.005 | <0.005 | <0.005 | <0.005 |
| V | 0.035 | 0.035 | 0.033 | 0.053 | 0.048 | 0.051 | 0.039 | 0.035 | 0.033 |
| W | 0.01 | 0.01 | 0.02 | 0.01 | 0.02 | 0.01 | 0.01 | 0.01 | 0.01 |

TABLE 2

| Results from the calculation of equations 1-3 for heats A-L. | | | | | | | | | |
|---|---|---|---|---|---|---|---|---|---|
| | Inventive steel alloy | | | | | | | | |
| Equation | Heat A | Heat B | Heat C | | | | | | |
| Eqn 1 | 19.2 | 19.2 | 19.7 | | | | | | |
| Eqn 2 | 13.4 | 13.3 | 12.7 | | | | | | |
| Eqn 3 | −36.6 | −34.4 | −33.5 | | | | | | |
| | Comparative steel alloy | | | | | | | | |
| | Heat D | Heat E | Heat F | Heat G | Heat H | Heat I | Heat J | Heat K | Heat L |
| Eqn 1 | 18.8 | 19.0 | 18.7 | 19.5 | 18.0 | 19.5 | 18.9 | 19.1 | 19.3 |
| Eqn 2 | 14.1 | 13.6 | 12.8 | 10.4 | 10.8 | 12.0 | 10.9 | 12.2 | 12.3 |
| Eqn 3 | −40.8 | −60.8 | −20.7 | 28.5 | 21.4 | 8.4 | −15.6 | −25.0 | −29.9 |

TABLE 3

| Fulfillment of conditions B1-B6 for heats A-L; | | | |
|---|---|---|---|
| | Inventive steel alloy | | |
| Condition | Heat A | Heat B | Heat C |
| B1 | YES | YES | YES |
| B2 | YES | YES | YES |

TABLE 3-continued

| Fulfillment of conditions B1-B6 for heats A-L; | | | |
|---|---|---|---|
| B3 | YES | YES | YES |
| B4 | YES | YES | YES |
| B5 | YES | YES | YES |
| B6 | YES | YES | YES |
| Composition within pre-characterizing part of claim 1 | YES | YES | YES |

| | Comparative steel alloy | | | | | | | | |
|---|---|---|---|---|---|---|---|---|---|
| Condition | Heat D | Heat E | Heat F | Heat G | Heat H | Heat I | Heat J | Heat K | Heat L |
| B1 | NO | NO | YES | YES | YES | YES | YES | YES | YES |
| B2 | YES | YES | YES | NO | YES | YES | YES | YES | YES |
| B3 | YES | YES | NO | NO | NO | NO | NO | NO | NO |
| B4 | YES | YES | YES | YES | YES | YES | YES | YES | YES |
| B5 | YES | YES | YES | YES | YES | YES | YES | YES | YES |
| B6 | YES | YES | NO | NO | NO | NO | NO | NO | YES |
| Composition within pre-characterizing part of claim 1 | NO | YES | YES | NO | NO | NO | NO | NO | YES |

YES = fulfils condition,
NO = does not fulfil condition.

The properties of each heat were then determined by a series of tests, described below, performed on the sample taken from each heat.

First, each sample was subjected to plastic deformation by pressing of the sample in a hydraulic press under increasing force until a thickness reduction corresponding to 60% plastic deformation was accomplished. The applied maximum force in kN was measured for each sample. The results are shown in table 4.

The Vickers hardness [HV1] of each sample was thereafter measured according to standard measurement procedure (SS112517). The results from the hardness measurement are shown in table 4.

The amount of deformation martensite formed during pressing [Mart.] as percentage of the total amount of phases in each sample was measured with a Ferritoscope as the difference in the amount of magnetic phase before and after the deformation of the samples. The results are shown in table 4.

The number of cracks formed in each sample during deformation was also counted around the circumference of the samples in a light optical microscope, after etching in oxalic acid of the microsamples. The results are shown in table 4.

In table 4 is shown that the samples of heats A, B, C could be deformed with relatively low deformation forces, ranging from 141 to 168 N. The hardness of the deformed samples ranges from 418 to 444 HV and the percentage of martensite in the samples ranges from 8 to 11 percent. Few cracks, numbering from 14 to 22, were observed in the samples.

Samples from heats D, G, H and I exhibited too high hardness after deforming, ranging from 474 to 484 HV, to be suitable for cold working into fine dimensions, A high number of cracks, 87 and 41, were observed in samples from heats G and I. Samples from heats E, F, J, K and L exhibited too high deformation force, 180 to 193 N, to be suitable for cold working with high reduction ratios. Samples from heats K and L exhibited in addition thereto relatively high hardness, 487 and 458 HV. A high number of cracks, 43 and 53 were also observed in samples from heats F and J.

From the results shown in table 4 it is evident that the samples taken from heats A, B and C indicate an excellent workability in cold conditions in comparison to samples taken from heats D, E, F, G, H, I, J, K, L. Thus, shown by the deformation force, hardness, martensite content and number of cracks, the samples taken from heats A, B and C exhibited a satisfactory mechanical strength and ductility to be subjected to thickness reductions corresponding to much larger reduction ratios than 60% plastic deformation, compared to the heats D, E, F, G, H, I, J, K, L.

TABLE 4

| Results from cold workability tests heats A-L | | | |
|---|---|---|---|
| Test | Inventive alloy | | |
| parameter | Heat A | Heat B | Heat C |
| Force (kN) | 168 | 164 | 141 |
| Hardness (HV1) | 418 | 426 | 444 |
| Mart. (%) | 8 | 8 | 11 |
| Cracks (no.) | 19 | 22 | 14 |

TABLE 4-continued

| Results from cold workability tests heats A-L | | | | | | | | | |
|---|---|---|---|---|---|---|---|---|---|
| Test | Comparative alloy | | | | | | | | |
| parameter | Heat D | Heat E | Heat F | Heat G | Heat H | Heat I | Heat J | Heat K | Heat L |
| Force (kN) | 174 | 188 | 193 | 174 | 163 | 175 | 186 | 180 | 181 |
| Hardness (HV1) | 478 | 412 | 414 | 474 | 484 | 484 | 430 | 487 | 458 |
| Mart. (%) | 4 | 4 | 9 | 14 | 33 | 16 | 21 | 10 | 7 |
| Cracks (no.) | 24 | 28 | 43 | 87 | 9 | 41 | 53 | 16 | 7 |

Example 2

A heat of the inventive steel alloy named M was prepared. Two heats named N and O of a slightly different composition were prepared for comparison. For comparison were also one heat, named P of steel alloy AISI 302, a standard spring steel alloy, prepared as well as one heat, named Q of steel alloy AISI 204Cu, a standard steel alloy of low nickel content.

The heats weighed approximately 10 metric tons each and were produced by melting component elements in an HF-furnace followed by refining in CLU-converter and ladle treatment. The separate heats were cast into 21" ingots. The composition of each heat is shown in table 5. Equations 1-3 were calculated for heats M-Q. Table 6 shows the results from the calculations. The results from table 6 were then compared with the conditions for each equation, B1-B6 and it was determined if the steel heats fulfilled the conditions B1-B6. Table 7 shows the result of the comparison. A "YES" means that the condition is fulfilled, a "NO" means that the condition is not fulfilled.

TABLE 5

| Composition of heats M-Q (in wt %) | | | | | |
|---|---|---|---|---|---|
| | Inventive alloy | Comparative steel alloys | | | |
| Alloy element | Heat M | Heat N | Heat O | Heat P (AISI302) | Heat Q (AISI204Cu) |
| C | 0.043 | 0.081 | 0.079 | 0.079 | 0.075 |
| N | 0.18 | 0.10 | 0.13 | 0.044 | 0.11 |
| Si | 0.37 | 0.25 | 0.34 | 0.45 | 0.25 |
| Mn | 4.99 | 2.15 | 3.05 | 1.20 | 8.09 |
| Ni | 3.72 | 3.69 | 3.71 | 8.11 | 2.75 |
| Cr | 18.34 | 18.28 | 18.25 | 17.91 | 16.24 |
| Cu | 2.50 | 3.64 | 2.94 | 0.66 | 2.12 |
| Mo | 0.01 | 0.01 | 0.01 | 0.33 | 0.17 |
| Nb | 0.01 | 0.01 | 0.01 | 0.01 | 0.007 |
| P | 0.012 | 0.012 | 0.009 | 0.026 | 0.038 |
| S | 0.002 | 0.0025 | 0.0015 | 0.0006 | 0.0002 |
| Al | 0.001 | 0.001 | <0.001 | <0.003 | <0.003 |
| Co | 0.04 | 0.03 | 0.04 | 0.057 | 0.046 |
| Ti | 0.001 | 0.001 | 0.001 | <0.005 | 0.005 |
| V | 0.05 | 0.04 | 0.04 | 0.051 | — |
| W | 0.01 | 0.01 | 0.01 | 0.03 | — |

TABLE 6

| Results from the calculation of equations 1-3 for heats M-Q | | | | | |
|---|---|---|---|---|---|
| | Inventive steel alloy | Comparative steel alloys | | | |
| Equation | Heat M | Heat N | Heat O | Heat P (AISI302) | Heat Q (AISI204Cu) |
| Eqn 1 | 19.4 | 19.0 | 19.2 | 19.6 | 17.0 |
| Eqn 2 | 12.8 | 10.8 | 11.8 | 12.4 | 12.5 |
| Eqn 3 | −27.5 | −16.2 | −16.3 | −26.2 | 30.3 |

TABLE 7

| Fulfillment of conditions B1-B6 for heats M-Q; YES = fulfils condition, NO = does not fulfil condition. | | | | | |
|---|---|---|---|---|---|
| | Inventive steel alloy | Comparative steel alloys | | | |
| Condition | Heat M | Heat N | Heat O | Heat P (AISI302) | Heat Q (AISI302) |
| B1 | YES | YES | YES | YES | NO |
| B2 | YES | NO | YES | YES | YES |
| B3 | YES | NO | NO | YES | NO |
| B4 | YES | YES | YES | YES | YES |
| B5 | YES | YES | YES | YES | YES |
| B6 | YES | NO | NO | YES | NO |
| Composition within pre-characterizing part of claim 1 | YES | NO | NO | NO | NO |

The heats were subjected to the following treatment:

Ingots of heat M as well as ingots of heats N, O, P, and Q of the comparative steel alloys were heated to a temperature of 1200° C. and formed by rolling into square bars of a final dimension of 150×150 $mm^2$.

The square bars were then heated to a temperature of 1250° C. and rolled into wire of a diameter of 5.5 mm. The wire rod was annealed directly after rolling at 1050° C. All heats had good hot working properties.

The hot rolled wires were finally cold drawn in several steps with intermediate annealing at 1050° C., into a final diameter of 1.4 mm, 1.0 mm. 0.60 mm and 0.66 mm. Wire was also cold rolled to a dimension of 2.75×0.40 $mm^2$. Samples were taken from the cold drawn wires.

The properties of the steel alloy of each heat were analyzed during cold working of the steel alloys and the results were documented. It was observed that the steel alloy of heat M had excellent workability, low deformation hardening and high ductility. All these properties were better or at the same level in comparison to heats P and Q of the standard AISI 302 or 204Cu grade steel. It was also observed that heat O had good workability but the deformation hardening was higher than AISI 302. Heat N became brittle already at low reductions and tension cracks were observed.

The properties of each steel alloy from heats M, N, O, P, and Q were determined as described below.

Tensile Strength

The tensile strength was determined according to standard SSEM 10002-1 on samples from wire rod (5.50 mm) and cold drawn wire from heats M, N, O and P. All samples were drawn and annealed with the same production parameters. The amount of martensite in the samples having a diameter of 5.50 mm by a magnetic balance equipment. The amount of martensite was again measured in samples that were drawn to a diameter of 1.4 mm and the increase in martensite phase was calculated. Table 8 shows the results from the tensile test and the amount of deformation martensite in the samples.

TABLE 8

Results from tensile tests on samples from heats M-P

| Heat | Dimension (mm) | Tensile strength (MPa) | Martensite (%) |
|---|---|---|---|
| Heat M | 5.50 | 684 | 0.3 |
| Heat M | 1.40 | 1978 | 12.7 |
| Heat M | 0.60 | 2063 | |
| Heat M | 0.66 | 1977 | |
| Heat M | 1.00 | 1980 | |
| Heat M | 2.75 × 0.40 | 1580 | |
| Heat N | 5.50 | 701 | 0.6 |
| Heat N | 1.40 | 2200 | 40.8 |
| Heat N | 0.60 | 2420 | |
| Heat N | 0.66 | 2348 | |
| Heat O | 5.50 | 683 | 0.2 |
| Heat O | 1.40 | 2210 | 23.9 |
| Heat O | 0.60 | 2274 | |
| Heat O | 0.66 | 2237 | |
| Heat O | 2.75 × 0.40 | 1670 | |
| Heat P (AISI302) | 5.50 | 697 | |
| Heat P (AISI302) | 0.60 | 2055 | |
| Heat P (AISI302) | 0.66 | 1999 | |

Best tensile results were achieved from heat M, especially for large total reductions. The steel alloy from heat M has the lowest strength and highest ductility, comparable to the tensile strength of heat P (AISI 302). Very little martensite was formed in sample M. The results further show that the steel alloy from heat O exhibits too high strength and too low ductility for cold working into fine dimensions, where large reduction ratios are necessary. All dimensions from samples of heat N were brittle, and steel alloy N is therefore less suitable for cold working. Most martensite was formed in sample N.

Tempering Effect

The tempering effect is important for many applications, especially for springs. A high tempering response will benefit many spring properties like spring force, relaxation and fatigue resistance.

To determine the tempering effect, samples of cold drawn wire were taken from heats M and P. The tensile strength of the wires was measured. The wires were coiled and heat treated to increase the strength (aging). The heat treatment also increases the toughness of the deformation martensite and releases stresses (tempering). After the heat treatment, the tensile strength of the wires was measured again and the tempering effect was determined as the increase in tensile strength. Table 9 shows the results of the tempering effect as increase in tensile strength for 1.0 mm wire at different temperatures, with a holding time of 1 hour.

The tensile increase for samples from heat M is much higher than samples from heat P (AISI 302). A high tensile increase is important for many applications, especially for spring applications. The high tempering response of heat M depends mainly on the high copper and nitrogen content, which increases the precipitation hardening of the steel alloy.

TABLE 9

Results of the tempering effect on tensile strength

| Heat | Temperature (° C.) | Tensile strength (MPa) | Tensile strength increase (%) |
|---|---|---|---|
| Heat M | RT | 1974 | |
| Heat M | 250 | 2174 | 10.1 |
| Heat M | 350 | 2247 | 13.8 |
| Heat P (AISI 302) | RT | 2146 | |
| Heat P (AISI 302) | 250 | 2253 | 5.0 |
| Heat P (AISI 302) | 350 | 2323 | 8.2 |

Relaxation

Relaxation is a very important parameter for spring applications. Relaxation is the spring force that the spring looses over time.

The relaxation property was determined for heats M and P. Samples of 1.0 mm wire were taken from each heat. Each wire sample was coiled to a spring and tempered at 350° C. for 1 hour. Each spring was thereafter stretched to a length that corresponds to a stress of 800, 1000, 1200 and 1400 MPa, respectively. The loss of spring force in Newton (N) was measured over 24 hours at room temperature. The relaxation is the loss of spring force measured in percent. The results from the test are shown in table 10.

TABLE 10

Loss of spring force

| Heat | Initial spring tension (MPa) | Relaxation (%) |
|---|---|---|
| Heat M | 800 | 0.73 |
| Heat M | 1000 | 0.90 |
| Heat M | 1200 | 1.38 |
| Heat M | 1400 | 1.99 |
| Heat P (AISI 302) | 800 | 0.90 |
| Heat P (AISI 302) | 1000 | 1.80 |
| Heat P (AISI 302) | 1200 | 3.70 |
| Heat P (AISI 302) | 1300 | 3.80 |

It can clearly be seen in table 10 that the relaxation of heat M is much lower than springs from samples of heat P (AISI 302), which thus makes the steel alloy from heat M much more suitable for spring applications.

Fatigue Strength

The fatigue strength was determined on samples from heats M and P. Springs manufactured from heats M and P were tempered at 350° C. for 1 hour. The springs were then fastened in a fixture and subjected to cyclic tension stresses. Ten springs were tested parallel at the same time. Each spring sample was tested at a given stress level until the sample failed, or until a maxim of 10,000,000 cycles were reached. The fatigue strength of the sample was then evaluated by using Wöhler S-N diagram. FIG. 1 shows the test result at 90% security against failure.

From FIG. 1 it is evident that the fatigue strength of the tempered spring from heat M is higher than that of springs from heat P (AISI 302).

Pitting Corrosion

The resistance against pitting corrosion was determined on the samples from heat M and from heat P (AISI 302) and heat Q (AISI 204Cu) by measuring the Critical Pitting Temperature (CPT) during electrochemical testing.

A 5.5 mm wire rod sample was taken from each steel heat. Each sample was grinded and polished to reduce the influence of surface properties. The samples were immersed in a 0.1% NaCl solution at a constant potential of 300 mV. The temperature of the solution was increased by 5° C. each 5 min until the point where corrosion on the samples could be registered. The result of the CPT testing is shown in table 11.

Table 11 shows that Heat M exhibit adequate resistance to pitting corrosion in comparison to Heat P (AISI 302). The results from the corrosion tests further show that heat M exhibits higher resistance to corrosion than heat Q (AISI 204Cu).

TABLE 11

Critical pitting temperature (CPT), measured at +300 mV and 0.1% NaCl.

| Sample | CPT, 0.1% NaCl, +300 mV (° C.) |
|---|---|
| Heat M | 60, 50 |
| Heat P (AISI 302) | 90, >95 |
| Heat Q (AISI 204Cu) | 35, 35 |

The invention claimed is:

1. An austenitic stainless steel alloy having the following composition in percent of weight (wt %):

$0.02 \leq C \leq 0.06$ $Si < 1.0$ $2.0 \leq Mn \leq 6.0$ $2.0 \leq Ni \leq 4.5$ $17 \leq Cr \leq 19$ $2.0 \leq Cu \leq 4.0$ $0.15 \leq N \leq 0.25$ $0 \leq Mo \leq 1.0$ $0 \leq W \leq 0.3$ $0.035 \leq V \leq 0.05$ $0 \leq Ti \leq 0.5$ $0 \leq Al \leq 1.0$ $0 \leq Nb \leq 0.5$ $0.025 \leq Co \leq 0.04$ the balance Fe and normally occurring impurities, wherein the contents of the alloying elements are balanced so that the following conditions are fulfilled:

$Ni_{eqv} - 1.42 * Cr_{eqv} \leq -13.42$; and $Ni_{eqv} + 0.85 * Cr_{eqv} > 29.00$ wherein $Cr_{eqv} = [\%\ Cr] + 2*[\%\ Si] + 1.5*[\%\ Mo] + 5*[\%\ V] + 5.5*[\%\ Al] + 1.75*[\%\ Nb] + 1.5*[\%\ Ti] + 0.75*[\%\ W]$ $Ni_{eqv} = [\%\ Ni] + [\%\ Co] + 0.5*[\%\ Mn] + 0.3*[\%\ Cu] + 25*[\%\ N] + 30*[\%\ C]$;

and $-37°\ C. < MD30 < -25°\ C.$ wherein $MD30 = (551 - 462*([\%\ C] + [\%\ N]) - 9.2*[\%\ Si] - 8.1*[\%\ Mn] - 13.7*[\%\ Cr] - 29*([\%\ Ni] + [\%\ Cu]) - 68*[\%\ Nb] - 18.5*[\%\ Mo])°\ C.$

2. The austenitic stainless steel alloy according to claim 1 wherein the contents of the alloy elements in the steel alloy are balanced such that the following condition is fulfilled:

$Ni_{eqv} - 1.42 * Cr_{eqv} \geq -16.00.$

3. The austenitic stainless steel alloy according to claim 1 wherein the contents of the alloy elements in the steel alloy are balanced such that the following condition is fulfilled:

$Ni_{eqv} + 0.85 * Cr_{eqv} \leq 31.00.$

4. The austenitic stainless steel alloy according to claim 1 wherein the contents of the alloy elements in the steel alloy are balanced such that the following condition is fulfilled:

$Ni_{eqv} + 0.85 * Cr_{eqv} \leq 30.00.$

5. The austenitic stainless steel alloy according to claim 1 wherein $0.2 \leq Si \leq 0.6$ wt %.

6. The austenitic stainless steel alloy according to claim 1 wherein $2.0 \leq Mn \leq 5.5$ wt %.

7. The austenitic stainless steel alloy according to claim 1 wherein $2.0 \leq Mn \leq 5.0$ wt %.

8. The austenitic stainless steel alloy according to claim 1 wherein $2.5 \leq Ni \leq 4.0$ wt %.

9. The austenitic stainless steel alloy according to claim 1 wherein $17.5 \leq Cr \leq 19$ wt %.

10. The austenitic stainless steel alloy according to claim 1 wherein $0 \leq Mo \leq 0.5$ wt %.

11. The austenitic stainless steel alloy according to claim 1 wherein each of W, V, Ti, Al, Nb is $\leq 0.2$ wt %.

12. The alloy according to claim 1, wherein the amounts of each of the elements W, V, Ti, Al, and $Nb \leq 0.1$ wt %, and where $(W + V + Ti + A1 + Nb) \leq 0.3$ wt %.

13. An article comprising the austenitic stainless steel alloy according to claim 1.

14. The article according to claim 13 wherein the article is a wire, a spring, a strip, a tube, a pipe, or a bar.

15. The article according to claim 13 wherein the article is an article manufactured by cold-heading or forging.

* * * * *